US006561548B1

(12) United States Patent
Mantel et al.

(10) Patent No.: US 6,561,548 B1
(45) Date of Patent: May 13, 2003

(54) PROTECTIVE DEVICE FOR SANITARY FITTINGS

(75) Inventors: Ralf Mantel, Gutach (DE); Werner Lorch, Schramberg (DE)

(73) Assignee: Hansgrohe, Schiltach (DE)

( * ) Notice: Subject to any disclaimer, the term of this patent is extended or adjusted under 35 U.S.C. 154(b) by 0 days.

(21) Appl. No.: 09/657,862

(22) Filed: Sep. 8, 2000

(30) Foreign Application Priority Data

Sep. 10, 1999 (DE) ..... 199 43 307

(51) Int. Cl.[7] ..... F16L 5/00

(52) U.S. Cl. ..... 285/64; 285/45; 285/125.1; 137/360

(58) Field of Search ..... 285/45, 46, 61, 285/64, 125.1; 52/34, 35; 137/356, 357, 360, 361

(56) References Cited

U.S. PATENT DOCUMENTS

| | | | | | |
|---|---|---|---|---|---|
| 347,084 | A | * | 8/1886 | Blackmore et al. | 285/45 |
| 1,724,233 | A | * | 8/1929 | Thatcher | 285/125.1 X |
| 1,949,883 | A | * | 3/1934 | Sharp | 285/125.1 X |
| 2,725,894 | A | * | 12/1955 | Mamoli | 137/360 |
| 3,823,737 | A | * | 7/1974 | Szymanski | 137/360 X |
| 3,937,499 | A | * | 2/1976 | Courtot | 285/61 X |
| 5,029,606 | A | * | 7/1991 | Kuhlthau, Jr. | 137/360 |
| 5,197,511 | A | * | 3/1993 | Kohn et al. | 137/360 |
| 5,497,584 | A | * | 3/1996 | Bergmann | 52/34 |
| 6,101,774 | A | * | 8/2000 | Heil | 285/64 X |
| 6,125,881 | A | * | 10/2000 | Hobbs et al. | 137/360 |
| 6,129,109 | A | * | 10/2000 | Humber | 137/360 |
| 6,148,850 | A | * | 11/2000 | Kopp et al. | 137/360 |

FOREIGN PATENT DOCUMENTS

| | | |
|---|---|---|
| DE | 41 33 266 A1 | 4/1993 |
| DE | 197 15 651 A1 | 10/1998 |

* cited by examiner

*Primary Examiner*—Lynne H. Browne
*Assistant Examiner*—David E. Bochna
(74) *Attorney, Agent, or Firm*—Duane Morris LLP

(57) ABSTRACT

A protective device for a sanitary fitting contains a covering, which during installation steps is mounted such that outlets of the fitting are sealed in pressure-resistant manner and/or are interconnected. This sealed covering is connected by separable means to a cylindrical skirt, which surrounds the fitting and/or the fitting part. After the installer tests the house plumbing and completes the wall surface, the covering is removed again from the sanitary fitting or the part thereof. As desired, it is also possible to remove the skirt or leave it in the wall. For this purpose the skirt is attached to the sealing part of the covering by easily separated ridges.

16 Claims, 1 Drawing Sheet

PROTECTIVE DEVICE FOR SANITARY FITTINGS

BACKGROUND O THE INVENTION

1. Field of the Invention

The invention relates to the installation and mounting of sanitary fittings, in particular providing a device for protection of a mounting block during installation, which facilitates flushing and testing.

2. Prior Art

Sanitary fittings are frequently secured in concealed form. This means that they are connected in a depression within a wall or niche to the house plumbing mains. This generally takes place prior to the completion of the wall surface. It is known to place in said niche so-called concealed boxes, which mainly serve to seal the sanitary fitting with respect to the wall. However, the concealed boxes can also be used in such a way that during installation they protect the fitting against dirt and damage.

It is also known to construct sanitary fittings in such a way that they comprise a connection block and the actual operational parts, which are connected to the connection block. Here connection only takes place of the connection block with the pipes within the niche and only after completing the wall surface are the operational parts connected to the connection block.

During the completion of the wall surface there is a risk of the sanitary fitting becoming damaged or of dirt penetrating openings leading to the water pipes and which can subsequently lead to a malfunction of the fittings.

SUMMARY OF THE INVENTION

An object of the invention is to provide a possibility of preventing any risk of contamination of pipe branches within a house plumbing system.

The protective device proposed by the invention can e.g. be fitted to the fitting or the connection block for the fitting in the factory. The connection block and/or fitting is then already protected during installation. The covering is fitted to the fitting part in such a way that the outlets which are or will be connected to the water pipes are protected against the penetration of dirt or the like.

It is also possible to fit the protective device to the fitting part only after installation has taken place, so that protection exists during the subsequent completion of the wall surface, e.g. by tiling.

As soon as the wall is completed, the covering can be removed again. This can take place either together with the skirt or apron or in such a way that said skirt or apron remains in the wall. It is e.g. conceivable for the skirt to be fixed to the tiles during the formation of a tile system. It is then appropriate to leave the skirt in the wall in order to bring about a clean definition of the niche. This is made possible by the invention, because only the separable means have to be removed, e.g. using pliers, a knife or some other tool, which the fitter normally carries with him.

According to a further development of the invention the covering is fastened by screws to fastening openings of the sanitary fitting or the connection block for the same. Thus, use is made of the already existing fastening holes. There is no need to adapt the fitting or connection block to the protective device.

According to a further development of the invention the skirt, which surrounds the fitting and which has a substantially closed circumference, is only connected to the covering device and is consequently not screwed to the fitting.

According to a further development of the invention the skirt is provided on its back directed towards the interior of the niche with open recesses for the connections leading to the fitting part.

The skirt can in particular be constructed in such a way that it extends to the bottom of a niche receiving the sanitary fitting.

The connecting means between the covering device and the skirt can e.g. be designed in such a way that when the covering is removed again from the fitting it is simply torn off. A possibility which is preferred in the present invention consists of implementing the connecting means by ridges present between the skirt and the covering. These ridges can e.g. be formed in that there are large area holes in a plate and the ridges are left between them. In particular these openings and/or ridges can be constructed in such a way that on the edge of the skirt a circumferential circular ridge is left and brings about a stiffening of the skirt.

For example the covering can be constructed on a roughly planar plate, which fills the inner area of the skirt with the exception of openings located along its edge.

According to another further development the covering covers the outlet so as not only to protect against the penetration of dirt, but also covers it so as to provide a seal to the outside in pressure-resistant manner. Thus, the protective device can also be used for carrying out a pressure test on the house plumbing pipes and for this purpose the covering remains fixed to the fitting part.

According to another further development the covering not only provides a pressure-resistant seal to the outside, but also connects two outlet, preferably in such a way that no undercut openings or edges are formed, so that it is possible to flush the mains.

It is particularly advantageous if the skirt is so constructed and dimensioned that not only the connection block for the sanitary fitting can be installed therein, but also the sanitary fittings.

BRIEF DESCRIPTION OF THE DRAWINGS

Further features, details and advantages of the invention can be gathered from the following description of a preferred embodiment and the attached drawings, wherein show.

DETAILED DESCRIPTION OF PREFERRED EMBODIMENTS

Figure 1:
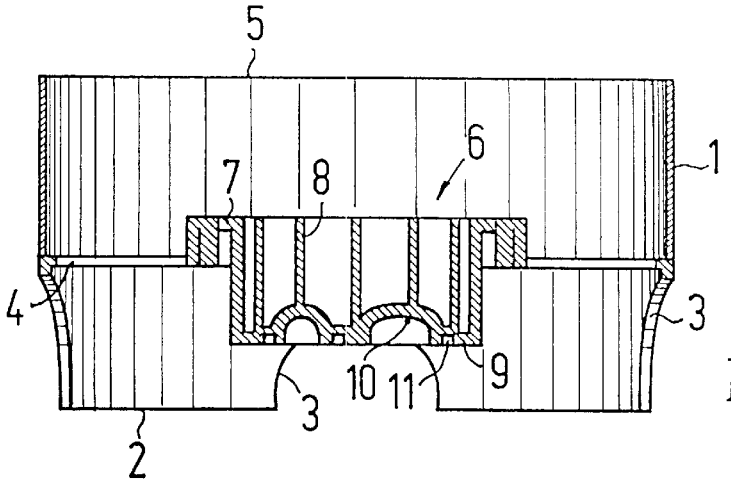
FIG. 1 A longitudinal section through a protective device for a sanitary fitting proposed by the present invention.

FIG. 1 shows in a longitudinal section the protective device according to the invention, the orientation being chosen in such a way that the lower side is directed into a depression of a wall or niche in which the fitting is housed. The protective device is molded in one piece from plastic. It contains a cylindrical apron or skirt 1, which has an oval cross-section. In the vicinity of its back 2 directed into the interior of the wall, the skirt contains several recesses 3 associated with the water pipes inside the wall. The skirt 1 is traversed by a planar plate element 4, which is parallel to the back 2 and the leading edge 5. The actual covering 6 is shaped centrally onto the plate element 4 and contains a block 7 with a plurality of reinforcing walls 8, the back 9 forming the surface with which the covering 6 engages on a connection block. In the example shown the back 9 contains two inwardly rounded channels 10, which form a link between in "each case two outlets of a connection block. The channels 10 are surrounded by grooves 11 for seals.

The protective device shown is placed on the front of a connection block 12 and screwed down using screws. In the example shown, cf. FIG. 2, the connection block 12 has four connections 13 for water pipes inside the wall. Towards the front it contains a planar surface 14 surrounded by four tapholes 15. Into the planar surface 14 issue four openings 16, which within the "connection block 12 are connected to the connections 13. For example an opening 16 could be connected to a hot water pipe, whilst a second opening is connected to a cold water pipe. One of the openings can also lead to a pipe connected to a shower head outflow. Thus, the openings 16 can both be outlets and openings through which the water flows from the sanitary fitting to be fixed back into the connection block 12. The function of the openings 6 is dependent on the course of the pipes. Thus, in the present application all the openings are referred to as outlets.

Figure 2:
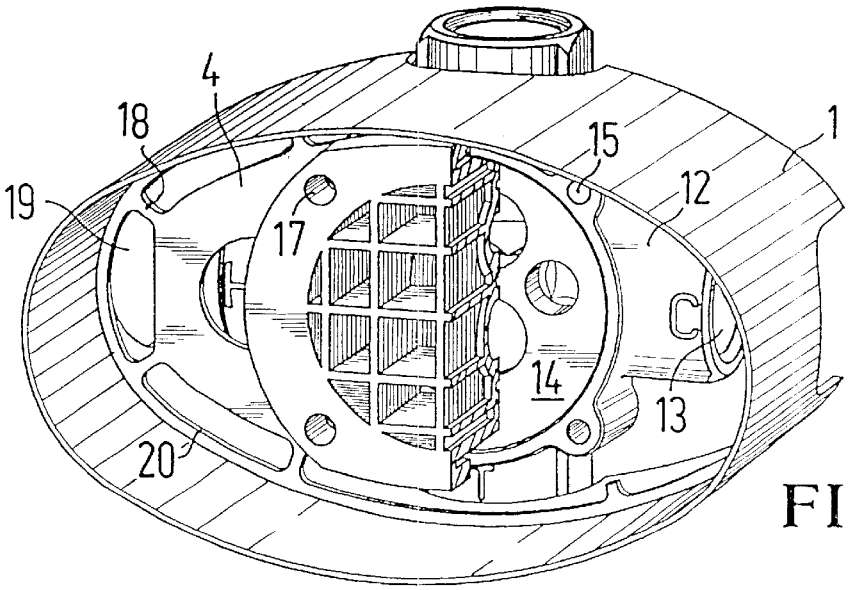
FIG. 2 Perspectively a partially broken away view of a protective device fixed to a functional block.

The covering is fixed with the aid of screws, which pass through throughbores 17 in the block 7 and engage in the tapholes 15. The channels 10 are oriented in such a way that they in each case interconnect two outlets 16. Towards the outside the block is sealed by said seals in the grooves 11. By the screwing down of the covering 6 the outlets 16 are sealed to the outside in a pressure-resistant and waterproof manner. The screwing down of the protective device onto the connection block 12 can, as stated, take place in the factory, so that the fitter receives a system as shown in FIG. 2 and fits it in the wall and connects it to the pipes.

It is also possible for the fitter to screw the protective device in situ to the connection block 12.

As soon as the connection block is assembled with the protective device, it is possible to flush and pressure test the pipes leading to the connection block 12. After such testing has taken place and when the wall surface has been completed, the screws can be unscrewed again. As a function of the particular case it is possible to remove the complete protective device, including the skirt 1, from the connection block 12. This takes place by simply drawing out to the front. However, if desired, the skirt 1 can remain in situ and for this purpose the ridges 18 are merely separated. The ridges 18 are formed by openings 19 present in the plate element 4. The openings 19 pass along the circumference of the plate element 4 and have a limited spacing from the skirt 1. As a result a ridge 20 is formed, which remains on the skirt 1 after the separation of the latter from the covering 6 and this brings about a certain reinforcement thereof.

Figure 3:
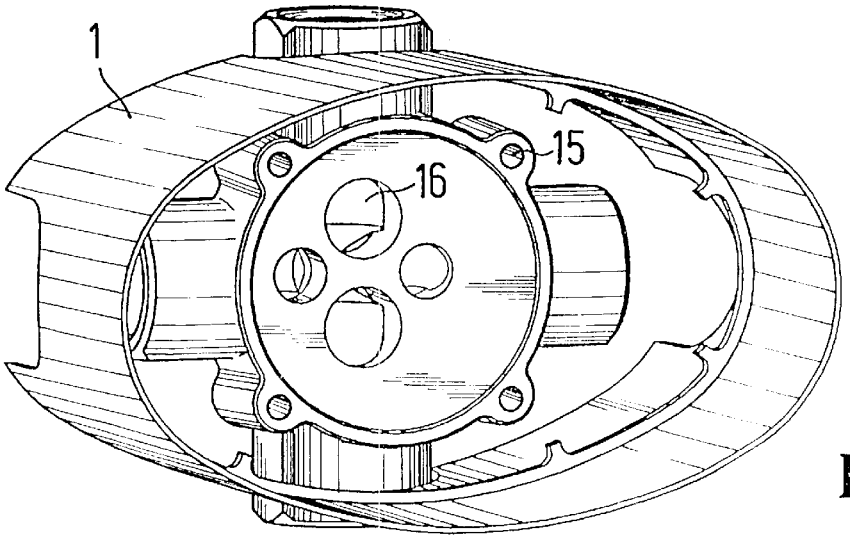
FIG. 3 Perspectively the connection block after removing the cover.

The situation on removing the covering is illustrated in FIG. 3. In this case the skirt 1 has remained in the wall, whereas the plate element 4 with the covering 6 has been removed. In this situation the fitting part cooperating with the connection block 12 can be fixed to the latter. The skirt 1, which is shaped like an oval cylinder, is dimensioned in such a way that the fitting can be housed within the skirt.

If the skirt 1 projects over the front of the wall surface, it can be separated there with a knife or saw.

What is claimed is:

1. A protective device for fittings having a connection block with outlets to which a sanitary fitting is to be coupled, comprising:

a covering, which can be fixed to the connection for the sanitary fitting and covers the outlets, the covering having a skirt which surrounds connection block, has a substantially closed circumference and is connected by separable means to the covering;

wherein the covering covers at least one of said outlets in a sealing and pressure-resistant manner;

wherein the skirt on one side has open recesses providing space for pipes leading to the connection block; and, wherein the connection block is arranged to be mounted at a bottom of a niche and the skirt is sized to extend to the bottom of the niche for the connection block.

2. The protective device according to claim 1, wherein the covering is screwed to fastening openings of the connection block.

3. The protective device according to claim 1, wherein the skirt is connected by ridges to a part of the covering that seals over the outlet.

4. The protective device according to claim 1, wherein the skirt is dimensioned such that the sanitary fitting when attached to the connection block fits within the skirt.

5. The protective device according to claim 1, wherein the skirt is cylindrical.

6. The protective device according to claim 1, wherein the covering interconnects at least two of said outlets.

7. A protective device for fittings having a connection block with outlets to which a sanitary fitting is to be coupled, comprising:

a covering, which can be fixed to the connection for the sanitary fitting and covers the outlets, the covering having a skirt which surrounds connection block, has a substantially closed circumference and is connected by separable means to the covering;

wherein the covering covers at least one of said outlets in a sealing and pressure-resistant manner;

wherein the skirt is connected by ridges to a part of the covering that seals over the outlet; and, wherein webs on an inside of the skirt extend into a circumferential ridge.

8. The protective device according to claim 7, wherein the skirt on one side has open recesses providing space for pipes leading to the connection block.

9. A protective device for fittings having a connection block with outlets to which a sanitary fitting is to be coupled, comprising:

a covering, which can be fixed to the connection block for the sanitary fitting and covers the outlets, the covering having a skirt which surrounds the connection block, has a substantially closed circumference and is connected by separable means to the covering;

wherein the covering interconnects at least two of said outlets;

wherein the skirt on one side has open recesses providing space for pipes leading to the connection block; and, wherein the connection block is arranged to be mounted at a bottom of a niche and the skirt is sized to extend to the bottom of the niche for the connection block.

10. The protective device according to claim 9, wherein the covering covers the outlets in a sealing and pressure-resistant manner.

11. The protective device according to claim 9, wherein the skirt is dimensioned such that the sanitary fitting when attached to the connection block fits within the skirt.

12. The protective device according to claim 9, wherein the skirt is cylindrical.

13. The protective device according to claim 9, wherein the covering is screwed to fastening openings of the connection block.

14. The protective device according to claim 9, wherein the skirt is connected by ridges to a part of the covering that seals over the outlet.

15. A protective device for fittings having a connection block with outlets to which a sanitary fitting is to be coupled, comprising:

a covering, which can be fixed to the connection block for the sanitary fitting and covers the outlets, the covering having a skirt which surrounds the connection block, has a substantially closed circumference and is connected by separable means to the covering;

wherein the covering interconnects at least two of said outlets;

wherein the skirt is connected by ridges to a part of the covering that seals over the outlet; and, wherein webs on an inside of the skirt extend into a circumferential ridge.

16. The protective device according to claim 15, wherein the skirt on one side has open recesses providing space for pipes leading to the connection block.

* * * * *